US008512063B2

(12) United States Patent
Fu et al.

(10) Patent No.: US 8,512,063 B2
(45) Date of Patent: Aug. 20, 2013

(54) ATTACHMENT MECHANISM FOR ELECTRONIC COMPONENT

(75) Inventors: Li-Ren Fu, Shenzhen (CN); Hung-Yi Wu, New Taipei (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/452,956

(22) Filed: Apr. 23, 2012

(65) Prior Publication Data

US 2013/0164954 A1 Jun. 27, 2013

(30) Foreign Application Priority Data

Dec. 26, 2011 (CN) ..... 2011 1 0440367

(51) Int. Cl.
*H01R 13/627* (2006.01)

(52) U.S. Cl.
USPC ..... 439/358

(58) Field of Classification Search
USPC ..... 439/358, 326, 65, 67, 493, 494–496, 439/498–499
See application file for complete search history.

(56) References Cited

U.S. PATENT DOCUMENTS

| | | | | | |
|---|---|---|---|---|---|
| 3,701,071 | A * | 10/1972 | Landman | 200/5 R |
| 4,678,252 | A * | 7/1987 | Moore | 439/62 |
| 4,718,859 | A * | 1/1988 | Gardner | 439/329 |
| 5,088,929 | A * | 2/1992 | Enomoto | 439/66 |
| 5,186,645 | A * | 2/1993 | Bixler | 439/358 |
| 5,268,820 | A * | 12/1993 | Tseng et al. | 361/785 |
| 6,102,727 | A * | 8/2000 | Kawaguchi et al. | 439/372 |
| 6,126,474 | A * | 10/2000 | Doye et al. | 439/357 |
| 6,416,343 | B1 * | 7/2002 | Chio | 439/326 |
| 7,220,142 | B2 * | 5/2007 | Liang | 439/326 |
| 8,130,489 | B2 * | 3/2012 | Chan et al. | 361/679.32 |

* cited by examiner

*Primary Examiner* — Neil Abrams
*Assistant Examiner* — Phuongchi T Nguyen
(74) *Attorney, Agent, or Firm* — Altis Law Group, Inc.

(57) ABSTRACT

An attachment mechanism for an electronic component includes a circuit board, an engaging member, and a pivoting member. The circuit board comprises a first connector to be connected to a second connector of the electronic component. The pivoting member is rotatably connected to the engaging member. The first connector is sandwiched by the pivoting member and the engaging member. The pivoting member includes a resilient bar to abut against a first end of a top surface of the electronic component.

14 Claims, 4 Drawing Sheets

ATTACHMENT MECHANISM FOR ELECTRONIC COMPONENT

CROSS-REFERENCE TO RELATED APPLICATIONS

Relevant subject matter is disclosed in six pending U.S. patent applications, all titled "ATTACHMENT MECHANISM FOR ELECTRONIC COMPONENT", respectively filed on Mar. 20, 2012, with the application Ser. No. 13/424,390, on Mar. 22, 2012, with the application Ser. No. 13/426,629, on Mar. 23, 2012, with the application Ser. No. 13/427,923, on Mar. 29, 2012, with the application Ser. No. 13/434,791, on Apr. 12, 2012, with the application Ser. No. 13/444,874, and on Apr. 13, 2012, with the application Ser. No. 13/445,935, which are assigned to the same assignee as this patent application.

BACKGROUND

1. Technical Field

The present disclosure relates to a mechanism for attaching an electronic component to a device.

2. Description of Related Art

Certain components in a server, such as expansion cards, need to be attached to the motherboard of the server. Taking such an expansion card for example, an end of the expansion card is fastened to the motherboard, and a connector at an opposite end of the expansion card is connected to a connector of the motherboard. However, the connection of the connectors may not be solid enough and the expansion card may disengage from the connector of the motherboard, which adversely influences the data transmission of the server.

BRIEF DESCRIPTION OF THE DRAWINGS

Many aspects of the present embodiments can be better understood with reference to the drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
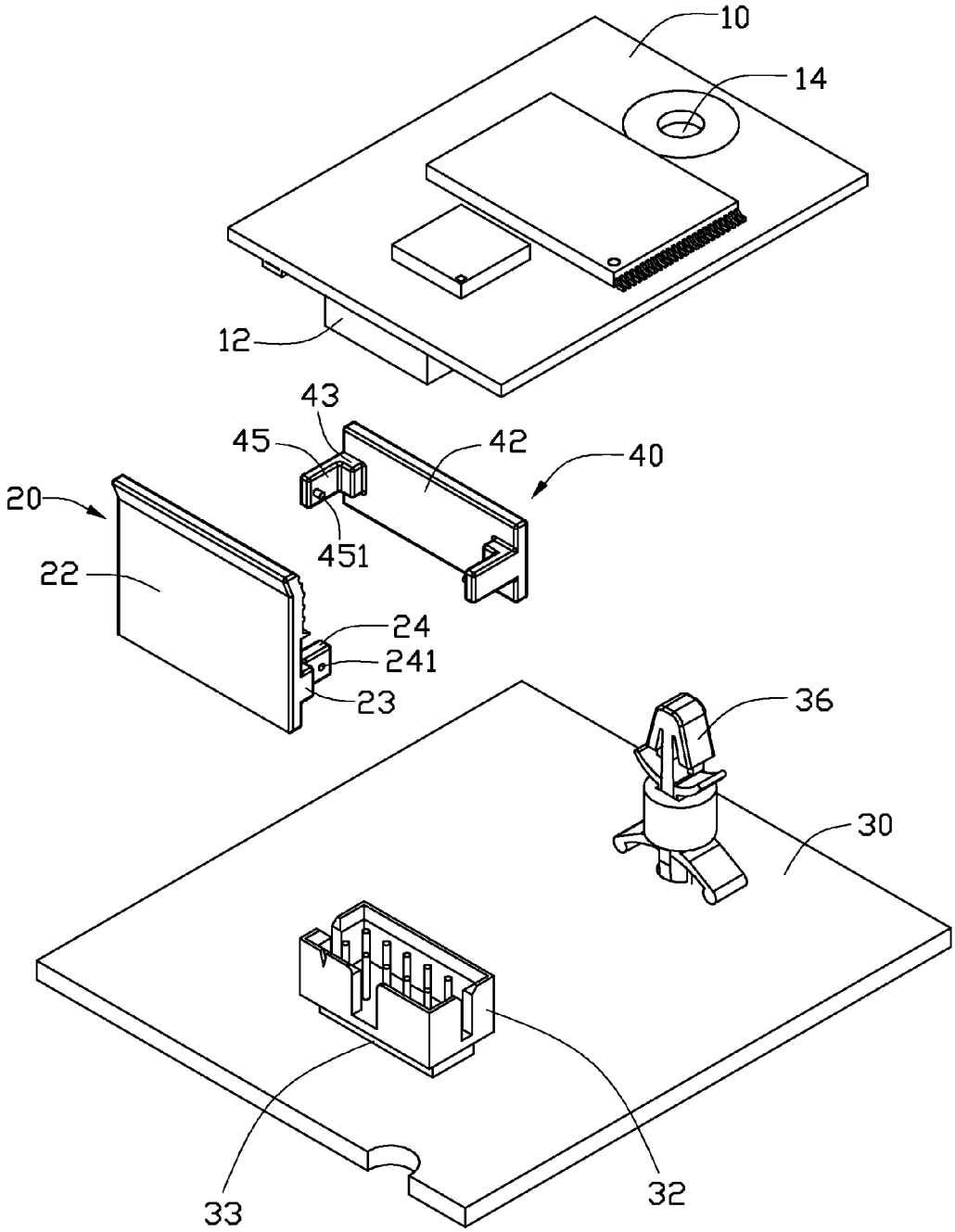
FIG. 1 is an exploded, isometric view of an exemplary embodiment of an attachment mechanism, together with an electronic component, wherein the attachment mechanism includes an engaging member and a pivoting member.

FIG. 1 shows an exemplary embodiment of an attachment mechanism for fastening an electronic component 10. The attachment mechanism includes a circuit board 30, a pivoting member 20, and an engaging member 40. The electronic component 10 includes a first connector 12 mounted to a first end of a side surface of the electronic component 10, and defines a through hole 14 in a second end of the electronic component 10 opposite to the first end.

A second connector 32 is fastened to the circuit board 30. A hooking slot 33 is defined between a side of a bottom of the second connector 32 and the circuit board 30. A hook 36 extends up from the circuit board 30.

Figure 2:
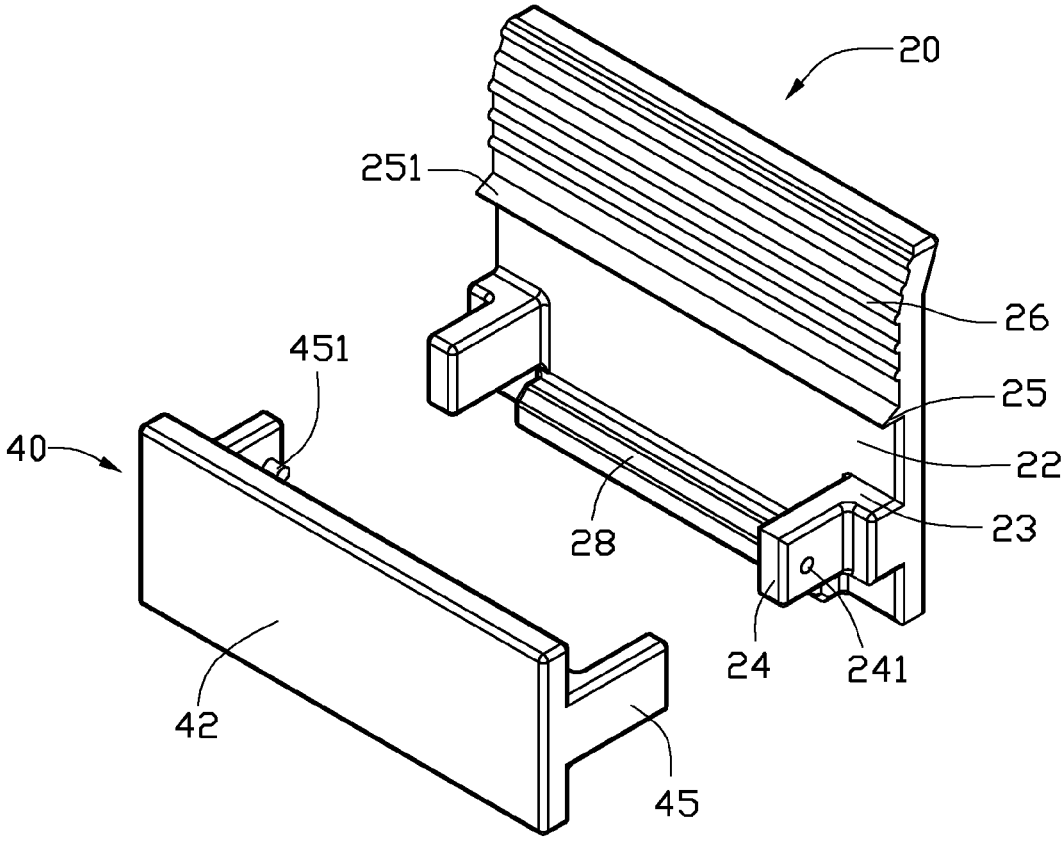
FIG. 2 is an enlarged view of the engaging member and the pivoting member of FIG. 1, but viewed from a different perspective.

FIG. 2 shows the pivoting member 20 including a substantially rectangular main body 22. A long resilient bar 25 protrudes from a middle of an inner side of the main body 22. A guiding surface 251 is formed on a top of the resilient bar 25, slantingly extending down. A plurality of strips 26 protrudes from an upper portion of the inner side of the main body 22, above the resilient bar 25, for conveniently manipulating the main body 22. Two blocks 23 protrude from opposite ends of a lower portion of the inner side of the main body 22, located below the resilient bar 25. A pivoting portion 24 perpendicularly extends from each block 23 adjacent to the other block 23. A pivot hole 241 is defined in a side of each pivoting portion 24 away from the other pivoting portion 24. A long engaging bar 28 protrudes from the lower portion of the inner side of the main body 22, located between and below the pivoting portions 24.

FIG. 1 shows the engaging member 40 including a plate 42. Two blocks 43 protrude from opposite ends of an inner side of the engaging member 40. A mounting arm 45 perpendicularly extends from each block 43 away from the other block 43. A pin 451 protrudes from a side of each mounting arm 45 facing the other mounting arm 45.

Figure 3:
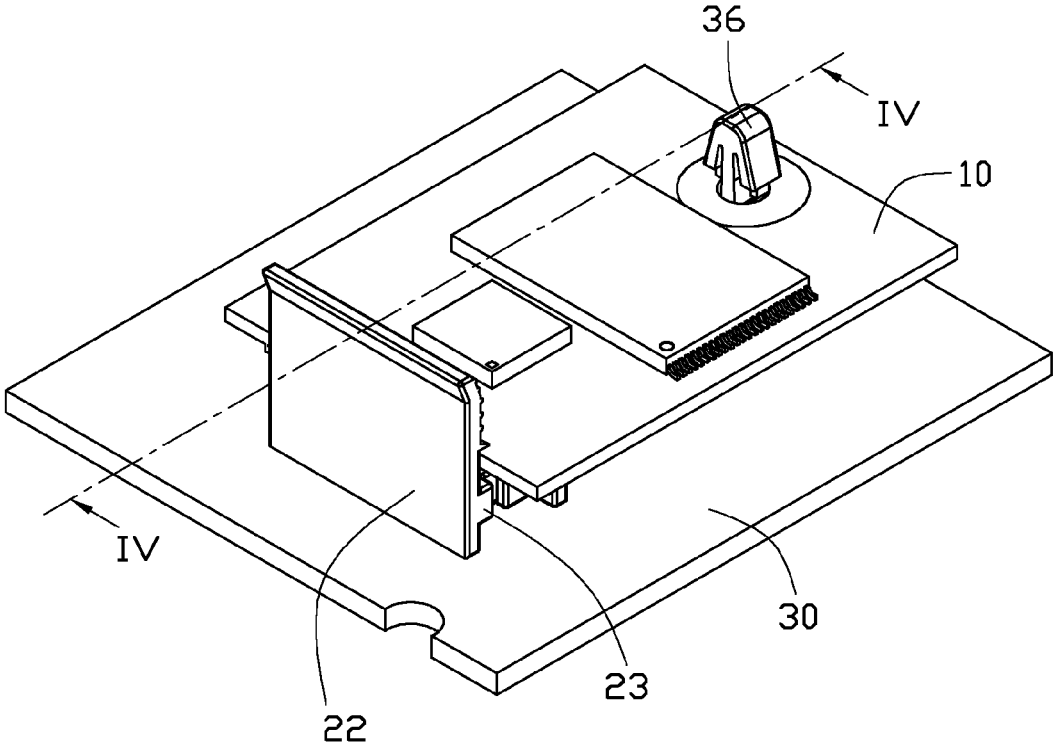
FIG. 3 is an assembled, isometric view of FIG. 1.
Figure 4:
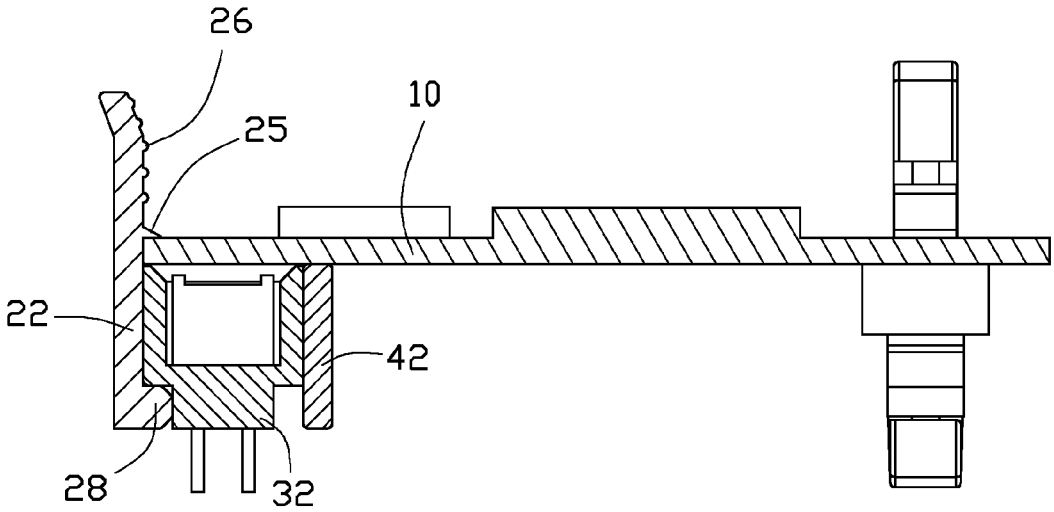
FIG. 4 is a sectional view taken along the line of IV-IV of FIG. 3.

FIGS. 3 and 4 show in assembly, the blocks 23 are aligned with the corresponding blocks 43. The pivoting member 20 and the engaging member 40 are manipulated toward each other. The mounting arms 45 are deformed to allow the pins 451 to abut against the corresponding pivoting portions 24. When the pins 451 align with the corresponding pivot holes 241, the mounting arms 45 are restored to allow the pins 451 to pivotably engage in the corresponding pivot holes 241. Therefore, the pivoting member 20 is pivotably mounted to the engaging member 40. The upper portion of the pivoting member 20 is rotated a certain angle toward the engaging member 40 so that the lower portion of the pivoting member 20 is rotated the certain angle away from the engaging member 40. The pivoting member 20 and the engaging member 40 are placed above the second connector 32 and then manipulated down. When the pivoting member 20 is adjacent to the circuit board 30, the upper portion of the pivoting member 20 is manipulated away from the second connector 32 so that the lower portion of the pivoting member 20 is rotated toward the second connector 32, to allow the engaging bar 28 to engage in the hooking slot 33. The pivoting member 20 and the engaging member 40 abut against opposite sides of the second connector 32. The pivoting portions 24 abut against opposite ends of the second connector 32. Thereby, the attachment mechanism is assembled.

To fasten the electronic component 10, the first connector 12 is aligned above the second connector 32. The electronic component 10 is manipulated down. The hook 36 extends through the through hole 14, to fasten the second end of the electronic component 10. When the first end of the electronic component 10 abuts against the guiding surface 251, the resilient bar 25 together with the pivoting member 20 above the resilient bar 25 is deformed away from the electronic component 10. After the first connector 12 is connected to the second connector 32, the pivoting member 20 is restored to allow the resilient bar 25 to abut against the first end of a top surface of the electronic component 10. Thereby, the electronic component 10 is fastened to the circuit board 30.

It is believed that the present embodiments and their advantages will be understood from the foregoing description, and various changes may be made thereto without departing from the spirit and scope of the description or sacrificing all of their materials advantages, the examples hereinbefore described merely being exemplary embodiments.

What is claimed is:

1. An attachment mechanism for fastening an electronic component, comprising:

a circuit board comprising a first connector to be connected to a second connector of the electronic component;

an engaging member; and a pivoting member rotatably connected to the engaging member, to sandwich the first connector with the engaging member, the pivoting member comprising a resilient bar to abut against a first end of a top surface of the electronic component.

2. The attachment mechanism of claim 1, wherein a guiding surface is formed on a top of the resilient bar, slantingly extending down.

3. The attachment mechanism of claim 1, wherein a through hole is defined in a second end of the electronic component, a hook extends up from the circuit board to engage in the through hole.

4. The attachment mechanism of claim 1, wherein the pivoting member comprises a main body and two pivoting portions perpendicularly extending from opposite ends of the main body toward the engaging member, the engaging member comprises a plate and two mounting arms perpendicularly extend from opposite ends of the plate, to be rotatably connected to the corresponding pivoting portions.

5. The attachment mechanism of claim 4, wherein a pivot hole is defined in a side of each pivoting portion away from the other pivoting portion, a pin protrudes from a side of each mounting arm facing the other mounting arm to engage in a corresponding pivot hole.

6. The attachment mechanism of claim 4, wherein a plurality of strips protrudes from an upper portion of an inner side of the main body.

7. The attachment mechanism of claim 4, wherein a hooking slot is defined in a side of a bottom of the first connector, an engaging bar protrudes from the main body to engage in the hooking slot.

8. A circuit board assembly, comprising:

a circuit board comprising a first connector;

an electronic component comprising a second connector to be connected to the first connector;

an engaging member; and a pivoting member rotatably connected to the engaging member, and sandwiching the first connector with the engaging member, the pivoting member comprising a resilient bar to abut against the first end of a top surface of the electronic component.

9. The circuit board assembly of claim 8, wherein a guiding surface is formed on a top of the resilient bar, slantingly extending down.

10. The circuit board assembly of claim 8, wherein a through hole is defined in a second end of the electronic component, a hook extends up from the circuit board to engage in the through hole.

11. The circuit board assembly of claim 8, wherein the pivoting member comprises a main body and two pivoting portions perpendicularly extending from opposite ends of the main body toward the engaging member, the engaging member comprises a plate and two mounting arms perpendicularly extend from opposite ends of the plate to be rotatably connected to the corresponding pivoting portions.

12. The circuit board assembly of claim 11, wherein a pivot hole is defined in a side of each pivoting portion away from the other pivoting portion, a pin protrudes from a side of each mounting arm facing the other mounting arm to engage in a corresponding pivot hole.

13. The circuit board assembly of claim 11, wherein a plurality of strips protrudes from an upper portion of an inner side of the main body.

14. The circuit board assembly of claim 11, wherein a hooking slot is defined in a side of a bottom of the first connector, an engaging bar protrudes from the main body to engage in the hooking slot.

* * * * *